US007364149B2

(12) United States Patent
Terao et al.

(10) Patent No.: US 7,364,149 B2
(45) Date of Patent: Apr. 29, 2008

(54) SHEET FINISHING APPARATUS

(75) Inventors: Yasunobu Terao, Shizuoka-ken (JP); Hajime Yamamoto, Shizuoka-ken (JP); Takahiro Kawaguchi, Shizuoka-ken (JP); Yoshiaki Sugizaki, Shizuoka-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 207 days.

(21) Appl. No.: 11/085,257

(22) Filed: Mar. 22, 2005

(65) Prior Publication Data

US 2006/0214344 A1 Sep. 28, 2006

(51) Int. Cl.
*B65H 37/04* (2006.01)

(52) U.S. Cl. ..... 270/58.13; 270/58.11; 270/58.12; 270/58.15; 270/58.19; 270/58.28; 399/124

(58) Field of Classification Search ..... 270/58.08, 270/58.09, 58.1, 58.11, 58.12, 58.13, 58.14, 270/58.15, 58.16, 58.17, 58.19, 58.28; 399/124, 399/125, 407, 408, 410
See application file for complete search history.

(56) References Cited

U.S. PATENT DOCUMENTS

| | | | | |
|---|---|---|---|---|
| 4,473,425 | A | 9/1984 | Baughman et al. | |
| 4,611,741 | A | 9/1986 | Wilson | |
| 4,794,859 | A | 1/1989 | Huseby et al. | |
| 4,849,796 | A | 7/1989 | Murakami | |
| 4,898,374 | A | 2/1990 | Vermaat | |
| 4,917,366 | A | 4/1990 | Murakami et al. | |
| 5,020,784 | A * | 6/1991 | Asami et al. | 270/58.11 |
| 5,021,837 | A | 6/1991 | Uto et al. | |

(Continued)

FOREIGN PATENT DOCUMENTS

| | | |
|---|---|---|
| JP | 61-078162 U | 5/1986 |

(Continued)

OTHER PUBLICATIONS

Y. Terao et al., U.S. PTO Office Action, U.S. Appl. No. 11/008,131, filed Oct. 17, 2006, 15 pages.

(Continued)

*Primary Examiner*—Gene O. Crawford
*Assistant Examiner*—Leslie A Nicholson, III
(74) *Attorney, Agent, or Firm*—Foley & Lardner LLP

(57) ABSTRACT

A sheet finishing apparatus of the present invention takes in sheets of paper ejected from an image forming apparatus through a taking-in port and clamping and conveying the sheets of paper by a pair of pinch rollers for post processing, has a sheet guidance member which supports one of the pair of pinch rollers and can rotate between a first position where the one pinch roller and the other pinch roller make contact with each other and a second position where the one pinch roller is released from the other pinch roller, and furthermore includes a tray for loading the sheets of paper conveyed by the pair of pinch rollers and an assist arm which is attached rotatably to the sheet guidance member and when the one pinch roller and the other pinch roller are in contact with each other, is projected in the direction for pressing the sheets of paper in the tray and when the one pinch roller is released from the other pinch roller, is rotated in the opposite direction.

2 Claims, 15 Drawing Sheets

U.S. PATENT DOCUMENTS 5,098,074 A 3/1992 Mandel et al.
5,282,611 A 2/1994 Ueda et al.
5,285,249 A 2/1994 Mahoney
5,289,251 A 2/1994 Mandel et al.
5,337,134 A * 8/1994 Sato et al. ..... 399/124
5,370,384 A 12/1994 Romanowski
5,418,606 A * 5/1995 Kikuchi et al. ..... 399/381
5,435,544 A 7/1995 Mandel
5,449,157 A 9/1995 Kawano et al.
5,451,037 A 9/1995 Lundstrom
5,590,871 A 1/1997 Okabe et al.
5,622,359 A 4/1997 Kawano et al.
5,628,502 A 5/1997 Amarakoon
5,640,232 A 6/1997 Miyake et al.
5,676,517 A 10/1997 Lotz
5,709,376 A 1/1998 Ushirogata
5,767,884 A 6/1998 Bortolotti et al.
5,934,140 A 8/1999 Jackson et al.
5,961,274 A 10/1999 Bors
5,971,384 A 10/1999 Asao
6,022,011 A * 2/2000 Hirose ..... 270/37
6,065,747 A 5/2000 Khovaylo et al.
6,092,948 A 7/2000 Altfather
6,102,385 A 8/2000 Wakamatsu et al.
6,120,020 A 9/2000 Asao
6,142,461 A 11/2000 Asao et al.
6,145,828 A * 11/2000 Arai ..... 271/3.03
6,146,085 A 11/2000 Namba et al.
6,179,287 B1 1/2001 Watanabe et al.
6,231,039 B1 5/2001 Chung
6,330,999 B2 12/2001 Coombs et al.
6,336,630 B1 1/2002 Holtman et al.
6,354,059 B1 3/2002 Yoshie et al.
6,357,753 B1 3/2002 Yamasaki et al.
6,371,472 B1 4/2002 Miyake et al.
6,450,934 B1 9/2002 Coombs
6,505,829 B2 1/2003 Kawata
6,581,922 B2 6/2003 Kuwata et al.
6,600,885 B2 * 7/2003 Kida ..... 399/124
6,641,129 B2 11/2003 Ogita et al.
6,659,455 B2 12/2003 Endo et al.
6,671,492 B2 12/2003 Mimura et al.
6,674,983 B2 * 1/2004 Enomoto et al. ..... 399/124
6,698,744 B2 3/2004 Yamada et al.
6,712,349 B2 3/2004 Watanabe
6,722,646 B2 4/2004 Sekiyama et al.
6,722,650 B1 4/2004 Abbata et al.
6,733,006 B2 5/2004 Kobayashi et al.
6,733,007 B2 5/2004 Sekiyama et al.
6,767,012 B2 7/2004 Sasamoto
6,819,906 B1 11/2004 Herrmann et al.
6,824,128 B2 11/2004 Nagata et al.
6,848,685 B2 2/2005 Katsuyama
6,871,042 B2 3/2005 Nemura et al.
6,910,686 B2 6/2005 Awano
6,928,259 B2 8/2005 Sakuma
6,988,728 B2 1/2006 Kida
7,104,538 B1 9/2006 Kimura et al.
2002/0047233 A1 4/2002 Coombs et al.
2002/0053766 A1 5/2002 Kubota
2002/0074708 A1 * 6/2002 Nagata et al. ..... 270/58.08
2002/0163119 A1 11/2002 Kawata
2003/0057625 A1 * 3/2003 Kuwata et al. ..... 270/58.02
2003/0155705 A1 * 8/2003 Sekiyama et al. ..... 271/241
2003/0214090 A1 * 11/2003 Kato et al. ..... 270/12
2004/0032073 A1 * 2/2004 Sasamoto ..... 271/3.03
2004/0113348 A1 6/2004 Awano
2004/0126163 A1 7/2004 Asami et al.
2004/0181308 A1 9/2004 Hayashi et al.
2005/0000336 A1 1/2005 Hattori et al.

FOREIGN PATENT DOCUMENTS

JP 62-008965 A 1/1987
JP 63-035756 U 3/1988
JP 63-180673 A 7/1988
JP 02-055369 A 2/1990
JP 03-088667 A 4/1991
JP 04-079857 U 7/1992
JP 04-312894 A 11/1992
JP 04-354756 A 12/1992
JP 05-238103 A 9/1993
JP 07-100563 B2 11/1995
JP 08-259073 A 10/1996
JP 09-309659 A 12/1997
JP 10-095563 A 4/1998
JP 10-279169 A 10/1998
JP 10-324449 A 12/1998
JP 11-011786 A 1/1999
JP 11-043257 A 2/1999
JP 11-147641 A 6/1999
JP 11-208967 A 8/1999
JP 11-231753 A 8/1999
JP 11-301912 A 11/1999
JP 2000-095420 A 4/2000
JP 2000-159414 A 6/2000
JP 2001-048411 A 2/2001
JP 2001-089009 A 4/2001
JP 2001-316029 A 11/2001
JP 2002-060118 A 2/2002
JP 2002-308509 A 10/2002
JP 2003-081517 A 3/2003
JP 2003-171057 A 6/2003
JP 2003-192210 A 7/2003
JP 2003-246536 A 9/2003
JP 2003-335450 A 11/2003
JP 2004-142868 A 5/2004

OTHER PUBLICATIONS

Y. Terao et al., U.S. PTO Office Action, U.S. Appl. No. 11/008,132, filed Nov. 24, 2006, 16 pages.
Y. Terao et al., U.S. PTO Office Action, U.S. Appl. No. 11/008,224, filed Nov. 17, 2006, 13 pages.
Y. Terao et al., U.S. PTO Office Action, U.S. Appl. No. 11/008,230, filed Nov. 13, 2006, 17 pages.
Y. Terao et al., U.S. PTO Office Action, U.S. Appl. No. 11/008,294, filed Oct. 24, 2006, 11 pages.
Y. Terao et al., U.S. PTO Office Action, U.S. Appl. No. 11/085,625, filed Nov. 21, 2006, 13 pages.
Y. Terao et al., Notice of Allowance and Fee(s) Due, U.S. Appl. No. 11/008,257, filed Oct. 24, 2006, 11 pgs.
Y. Terao et al., Notice of Allowance and Fee(s) Due, U.S. Appl. No. 11/008,295, filed Sep. 21, 2006, 7 pages.
Y. Terao et al., Notice of Allowance and Fee(s) Due, U.S. Appl. No. 11/008,350, filed Sep. 21, 2006, 7 pages.
Y. Terao et al., Notice of Allowance and Fee(s) Due, U.S. Appl. No. 11/008,392, filed Sep. 15, 2006, 10 pages.
Y. Terao et al., U.S. PTO Office Action, U.S. Appl. No. 11/008,381, filed Aug. 23, 2006, 17 pages.
Y. Terao et al., U.S. PTO Office Action, U.S. Appl. No. 11/008,567, filed Aug. 21, 2006, 14 pages.
Y. Terao, et al., Notice of Allowance and Fee(s) Due, U.S. Appl. No. 11/008,222, filed Aug. 31, 2006, 12 pgs.
Y. Terao, et al., Notice of Allowance and Fee(s) Due, U.S. Appl. No. 11/008,299, filed Sep. 6, 2006, 9 pgs.
Y. Terao et al., Notice of Allowance and Fee(s) Due, U.S. Appl. No. 11/085,244, filed Jul. 13, 2006, 10 pages.
Y. Terao et al., U.S. PTO Office Action, U.S. Appl. No. 11/008,145, filed Jun. 30, 2006, 6 pgs.
Y. Terao et al., U.S. PTO Office Action, U.S. Appl. No. 11/008,147, filed Jul. 7, 2006, 4 pgs.

Y. Terao et al., U.S. PTO Office Action, U.S. Appl. No. 11/008,290, filed Jul. 21, 2006, 15 pgs.
Y. Terao et al., U.S. PTO Office Action, U.S. Appl. No. 11/008,350, filed Jul. 6, 2006, 12 pgs.
Y. Terao et al., U.S. PTO Office Action, U.S. Appl. No. 11/085,226, filed Jul. 20, 2006, 12 pages.
Y. Terao et al., U.S. PTO Office Action, U.S. Appl. No. 11/085,227, filed Aug. 11, 2006, 15 pages.
Y. Terao et al., U.S. PTO Office Action, U.S. Appl. No. 11/085,240, filed Aug. 02, 2006, 15 pages.
Y. Terao et al., U.S. PTO Office Action, U.S. Appl. No. 11/085,247, filed Jul. 13, 2006, 14 pgs.
Y. Terao et al., U.S. PTO Office Action, U.S. Appl. No. 11/085,248, filed Jul. 5, 2006, 15 pgs.
Y. Terao et al., U.S. PTO Office Action, U.S. Appl. No. 11/085,256, filed Jul. 13, 2006, 13 pgs.
Y. Terao et al., U.S. PTO Office Action, U.S. Appl. No. 11/085,625, filed Jul. 28, 2006, 13 pgs.
Y. Terao et al., Notice of Allowance and Fee(s) Due, U.S. Appl. No. 11/008,122, filed Jul. 26, 2006, 8 pgs.
Y. Terao et al., Notice of Allowance and Fee(s) Due, U.S. Appl. No. 11/008,148, filed Jun. 26, 2006, 10 pages.
Y. Terao et al., Notice of Allowance and Fee(s) Due, U.S. Appl. No. 11/008,251, filed Jun. 26, 2006, 10 pages.
Y. Terao et al., Notice of Allowance and Fee(s) Due, U.S. Appl. No. 11/085,241, filed Jun. 26, 2006, 10 pages.
Y. Terao et al., Notice of Allowance and Fee(s) Due, U.S. Appl. No. 11/085,243, filed Jun. 26, 2006, 10 pages.
Y. Terao et al., U.S. PTO Office Action, U.S. Appl. No. 11/008,132, filed Jun. 9, 2006, with attached Notice of Withdrawal from Issue dated May 30, 2006, 11 pgs.
Y. Terao et al., U.S. PTO Office Action, U.S. Appl. No. 11/008,295, filed Jun. 23, 2006, 14 pgs.
K. Sasahara et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,349, filed Apr. 2, 2005, 9 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,294, filed May 5, 2006, 13 pages.
Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,392, filed Apr. 26, 2006, 10 pages.
U.S. Appl. No. 11/008,122, filed Dec. 10, 2004, Sasahara.
U.S. Appl. No. 11/008,567, filed Dec. 10, 2004, Terao et al.
U.S. Appl. No. 11/085,251, Mar. 22, 2005, Iizuka et al.
Y. Terao et al., Notice of Allowance and Fee(s) Due, U.S. Appl. No. 11/008,132, filed Oct. 6, 2005, 9 pages.
Y. Terao et al., U.S. PTO Notice of Allowance, U.S. Appl. No. 11/085,243, filed Jan. 5, 2006, with attached Notice of Withdrawal from Issue dated Jan. 10, 2006, 10 pgs.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,148, filed Jan. 11, 2006, 12 pages.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,224, filed Nov. 21, 2005, 9 pages.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/008,251, filed Jan. 13, 2006, 11 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,290, filed Nov. 30, 2005, 9 pages.
Y. Terao et al., U.S. PTO Office Action, U.S. Appl. No. 11/008,295, filed Jan. 5, 2006, 11 pages.
Y. Terao et al., U.S. PTO Office Action, U.S. Appl. No. 11/008,350, filed Jan. 26, 2006, 12 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Jan. 26, 2006, 8 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.
Y. Terao et al., U.S. PTO Office Action, U.S. Appl. No. 11/008,294, filed Dec. 13, 2005, 9 pages.
Y. Terao et al., U.S. PTO Office Action, U.S. Appl. No. 11/008,299, filed Dec. 13, 2005, 9 pages.
Y. Terao et al., U.S. PTO Office Action, U.S. Appl. No. 11/008,349, filed Dec. 13, 2005, 9 pages.
Y. Terao et al., U.S. PTO Office Action, U.S. Appl. No. 11/008,567, filed Dec. 13, 2005, 9 pages.
Y. Terao et al., Notice of Allowance and Fee(s) Due, U.S. Appl. No. 11/008,124, filed Sep. 30, 2005, 9 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,248, filed Mar. 22, 2005, Terao et al.
U.S. Appl. No. 11/085,240, filed Mar. 22, 2005, Terao et al.
U.S. Appl. No. 11/085,247, filed Mar. 22, 2005, Terao et al.
U.S. Appl. No. 11/085,250, filed Mar. 22, 2005, Terao et al.
U.S. Appl. No. 11/085,244, filed Mar. 22, 2005, Terao et al.
U.S. Appl. No. 11/085,243, filed Mar. 22, 2005, Terao et al.
U.S. Appl. No. 11/085,242, filed Mar. 22, 2005, Terao et al.
U.S. Appl. No. 11/085,241, filed Mar. 22, 2005, Terao et al.
U.S. Appl. No. 11/085,625, filed Mar. 22, 2005, Terao et al.
U.S. Appl. No. 11/085,256, filed Mar. 22, 2005, Terao et al.
U.S. Appl. No. 11/085,264, filed Mar. 22, 2005, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,222, filed Dec. 10, 2004, Terao et al.
U.S. Appl. No. 11/008,381, filed Dec. 10, 2004, Terao et al.
U.S. Appl. No. 11/008,132, filed Dec. 10, 2004, Terao et al.
U.S. Appl. No. 11/008,131, filed Dec. 10, 2004, Terao et al.
U.S. Appl. No. 11/008,142, filed Dec. 10, 2004, Terao et al.
U.S. Appl. No. 11/008,199, filed Dec. 10, 2004, Terao et al.
U.S. Appl. No. 11/008,145, filed Dec. 10, 2004, Terao et al.
U.S. Appl. No. 11/008,124, filed Dec. 10, 2004, Terao et al.
U.S. Appl. No. 11/008,350, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,349, filed Dec. 10, 2004, Terao et al.
U.S. Appl. No. 11/008,294, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,290, filed Dec. 10, 2004, Terao et al.
U.S. Appl. No. 11/008,392, filed Dec. 10, 2004, Terao et al.
U.S. Appl. No. 11/008,299, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,295, filed Dec. 10, 2004, Terao et al.
U.S. Appl. No. 11/008,251, filed Dec. 10, 2004, Terao et al.

Y. Terao et al., Notice of Allowance and Fee(s) Due, U.S. Appl. No. 11/008,294, filed Feb. 6, 2007, 7 pages.
Y. Terao et al., Notice of Allowance and Fee(s) Due, U.S. Appl. No. 11/008,381, filed Feb. 22, 2007, 23 pages.
Y. Terao et al., Notice of Allowance and Fee(s) Due, U.S. Appl. No. 11/008,567, filed Mar. 1, 2007, 6 pages.
Y. Terao et al., Notice of Allowance and Fee(s) Due, U.S. Appl. No. 11/085,247, filed Feb. 28, 2007, 14 pages.
Y. Terao et al., U.S. PTO Office Action, U.S. Appl. No. 11/008,131, filed Feb. 8, 2007, 22 pages.
Y. Terao et al., U.S. PTO Office Action, U.S. Appl. No. 11/008,224, filed Feb. 28, 2007, 11 pages.
Y. Terao et al., U.S. PTO Office Action, U.S. Appl. No. 11/085,226, filed Jan. 29, 2007, 6 pages.
C. Iizuka et al., U.S. PTO Office Action, U.S. Appl. No. 11/085,251, filed Jun. 25, 2007, 28 pgs.
Y. Terano et al., Notice of Allowance and Fee(s) Due, U.S. Appl. No. 11/008,132, filed Jun. 1, 2007, 11 pgs.
Y. Terano et al., Notice of Allowance and Fee(s) Due, U.S. Appl. No. 11/008,294, filed Jun. 14, 2007, 6 pgs.
Y. Terano et al., Notice of Allowance and Fee(s) Due, U.S. Appl. No. 11/008,381, filed Jun. 29, 2007, 6 pgs.
Y. Terao et al., U.S. PTO Office Action, U.S. Appl. No. 11/085,242, filed Jul. 10, 2007, 9 pgs.
Y. Terao et al., U.S. PTO Office Action, U.S. Appl. No. 11/085,250, filed Jun. 20, 2007, 24 pgs.
Y. Terao et al., U.S. PTO Office Action, U.S. Appl. No. 11/085,625, filed Jul. 10, 2007, 11 pgs.
Y. Terao et al., Notice of Allowance and Fee(s) Due, U.S. Appl. No. 11/008,290, filed Aug. 02, 2007, 9 pages.
Y. Terao et al., Notice of Allowance and Fee(s) Due, U.S. Appl. No. 11/008,299, filed Jul. 23, 2007, 10 pages.
Y. Terao et al., Notice of Allowance and Fee(s) Due, U.S. Appl. No. 11/085,240, filed Jul. 24, 2007, 20 pages.
Y. Terao et al., Notice of Allowance and Fee(s) Due, U.S. Appl. No. 11/085,248, filed Aug. 16, 2007, 8 pages.
Y. Terao et al., Notice of Allowance and Fee(s) Due, U.S. Appl. No. 11/008,131, filed Sep. 26, 2007, 12 pages.
Y. Terao et al., U.S. PTO Office Action, U.S. Appl. No. 11/008,199, filed Aug. 30, 2007, 18 pages.
Y. Terao et al., U.S. PTO Office Action, U.S. Appl. No. 11/008,224, filed Aug. 28, 2007, 8 pages.
Y. Terao et al., U.S. PTO Office Action, U.S. Appl. No. 11/008,248, filed Aug. 22, 2007, 8 pages.
Y. Terao et al., Notice of Allowance and Fee(s) Due, U.S. Appl. No. 11/085,264, filed Sep. 12, 2007, 16 pages.
Y. Terao et al., U.S. PTO Office Action, U.S. Appl. No. 11/822,611, filed Sep. 25, 2007, 20 pages.
Y. Terao et al., U.S. PTO Office Action, U.S. Appl. No. 11/826,731, filed Sep. 13, 2007, 21 pages.
Y. Terao et al., Notice of Allowance and Fee(s) Due, U.S. Appl. No. 11/008,142, filed Jan. 5, 2007, 24 pages.
Y. Terao et al., Notice of Allowance and Fee(s) Due, U.S. Appl. No. 11/008,145, filed Dec. 14, 2006, 20 pages.
Y. Terao et al., Notice of Allowance and Fee(s) Due, U.S. Appl. No. 11/008,147, filed Nov. 17, 2006, 7 pages.
Y. Terao et al., U.S. PTO Office Action, U.S. Appl. No. 11/008,248, filed Jan. 8, 2007, 25 pgs.
Y. Terao et al., U.S. PTO Office Action, U.S. Appl. No. 11/0858,248, filed Oct. 24, 2006, 12 pages.
Y. Terao et al., U.S. PTO Office Action, U.S. Appl. No. 11/008,290, filed Mar. 9, 2007, 8 pages.
Y. Terao et al., U.S. PTO Office Action, U.S. Appl. No. 11/085,240, filed Mar. 12, 2007, 15 pages.
Y. Terao et al., U.S. PTO Office Action, U.S. Appl. No. 11/085,242, filed Mar. 23, 2007, 20 pages.
Y. Terao et al., U.S. PTO Office Action, U.S. Appl. No. 11/085,248, filed Apr. 10, 2007, 12 pages.
Y. Terao et al., U.S. PTO Office Action, U.S. Appl. No. 11/085,264, filed Mar. 23, 2007, 21 pages.
Y. Terao et al., U.S. PTO Office Action, U.S. Appl. No. 11/008,224, Dec. 14, 2007, 9 pgs.
C. Iizuka et al., U.S. PTO Office, U.S. Appl. No. 11/085,251, Oct. 16, 2007, 10 pages.
Y. Terao et al., Notice of Allowance and Fee(s) Due, U.S. Appl. No. 11/085,242, Nov. 7, 2007, 10 pages.
Y. Terao et al., U.S. PTO Office, U.S. Appl. No. 11/085,250, Nov. 20, 2007, 13 pages.
Y. Terao et al., U.S. PTO Office, U.S. Appl. No. 11/085,625, Nov. 2, 2007, 11 pages.

* cited by examiner

SHEET FINISHING APPARATUS

BACKGROUND OF THE INVENTION

1. Field of the Invention

The present invention relates to a sheet finishing apparatus for post-processing sheets of paper ejected from an image forming apparatus such as a copier, a printer, or a composite device.

2. Description of the Related Art

In recent years, there has been an image forming apparatus used in which to perform a post process of sorting and stapling sheets of paper after image forming, a sheet finishing apparatus is installed adjacent to the paper ejection unit of the image forming apparatus body.

In Japanese Patent Publication 7-100563, a finisher having an online mode in which the image forming apparatus body and stapler are operated together and an offline mode in which the stapler is operated independently for performing the stapling process when the offline mode is selected is described.

However, in such a post processing apparatus, the so-called paper jamming, that is, jamming of sheets of paper in the conveying path may occur and it is not easy for a user to release the paper jamming. Further, after the paper jamming is released, an operation for returning the apparatus to its original state may not be performed smoothly.

DETAILED DESCRIPTION OF THE INVENTION

Throughout this description, the embodiments and examples shown should be considered as exemplars, rather than limitations on the apparatus of the present invention.

Hereinafter, the embodiment of the present invention will be explained in detail with reference to the accompanying drawings.

Figure 1:
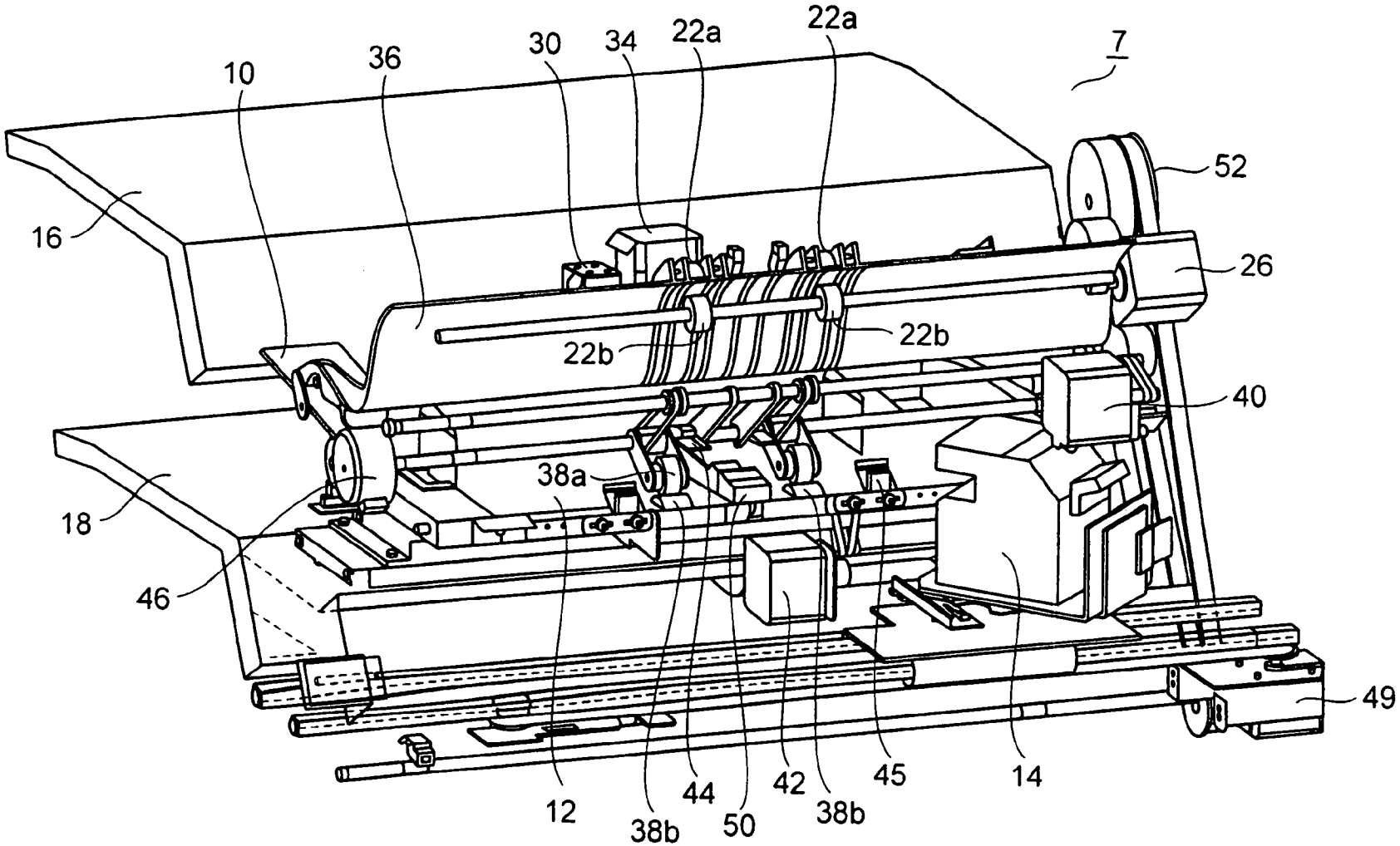
FIG. 1 is a perspective view showing the essential section of the sheet finishing apparatus relating to an embodiment of the present invention.
Figure 2:
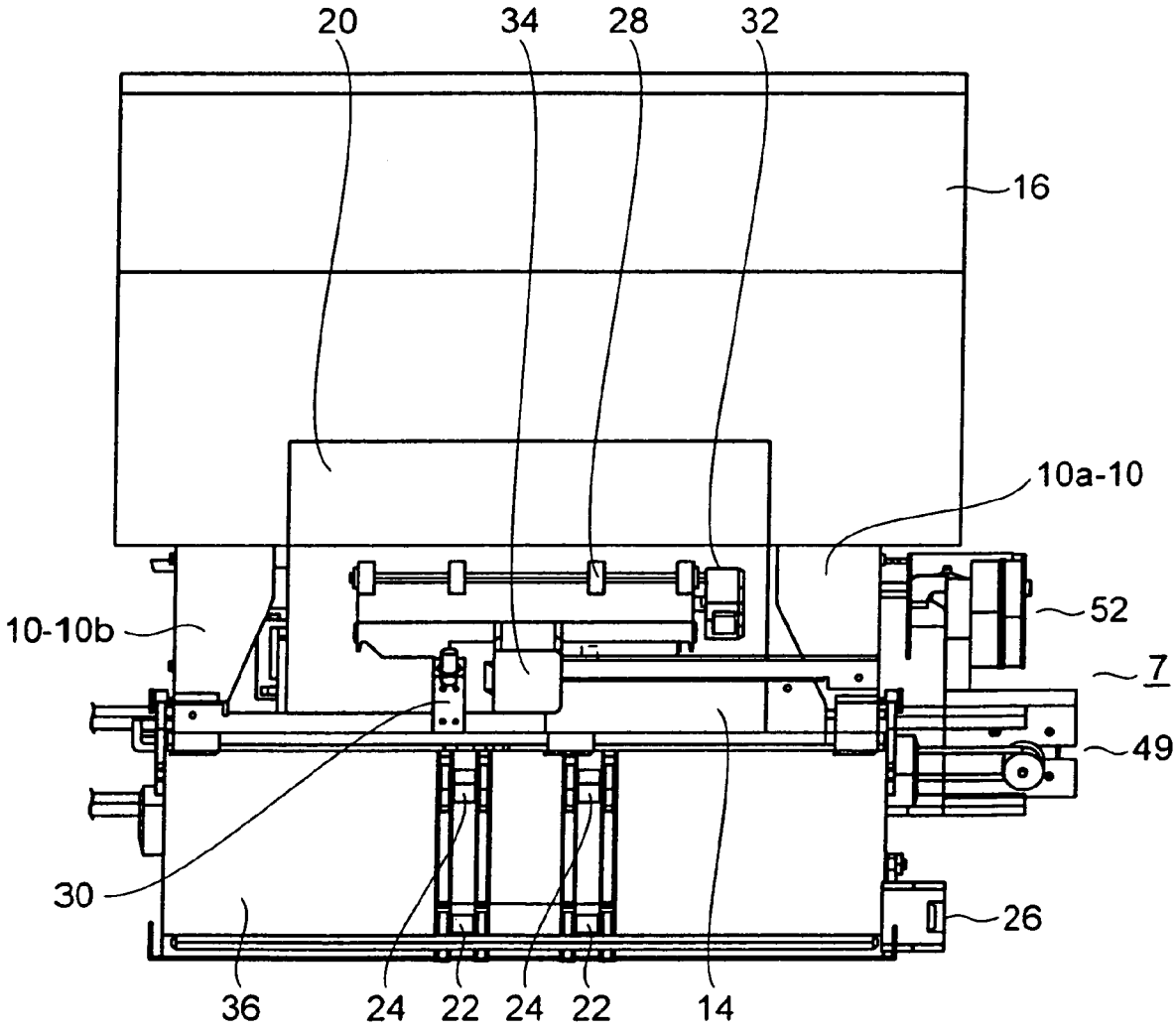
FIG. 2 is a top view showing the essential section of the sheet finishing apparatus relating to an embodiment of the present invention.
Figure 3:
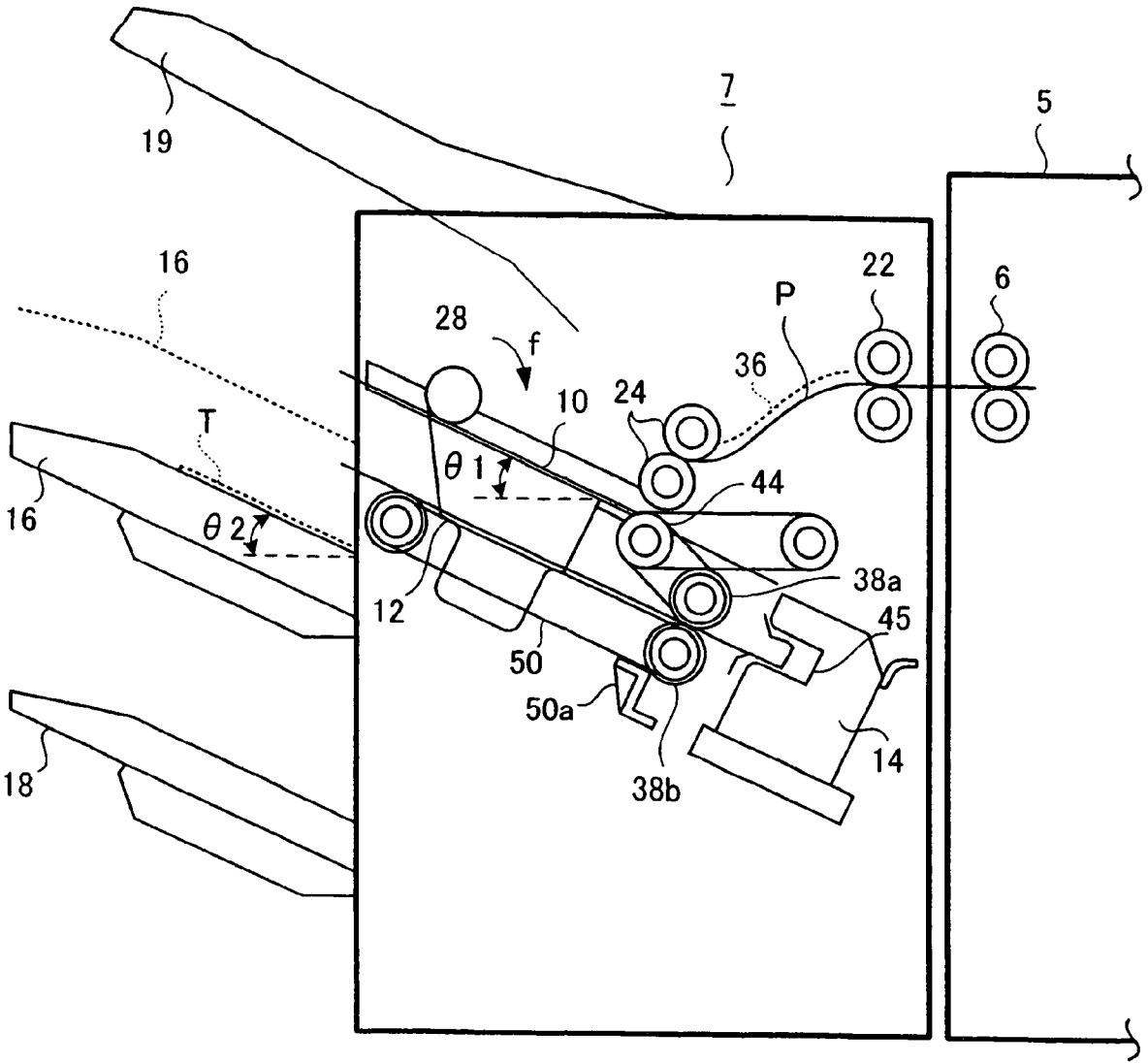
FIG. 3 is a schematic block diagram showing the sheet finishing apparatus relating to an embodiment of the present invention.

Further, in each drawing, to the same parts, the same numerals are assigned and duplicated explanation omitted. FIG. 1 is a perspective view showing the essential section of a sheet finishing apparatus 7 relating to an embodiment of the present invention, and FIG. 2 is a top view showing the essential section of the sheet finishing apparatus relating to an embodiment of the present invention, and FIG. 3 is a schematic block diagram showing the sheet finishing apparatus 7 arranged adjacent to an image forming apparatus 5 such as a copier.

The sheet finishing apparatus 7 basically has a standby tray 10, a processing tray 12, a stapler 14, a first paper ejection tray 16, a second paper ejection tray 18, a fixing tray 19, and a gate G.

A sheet of paper P, which an image is formed thereon by the image forming apparatus 5 such as a copier and ejected from a pair of paper ejection rollers 6, is received by a pair of inlet rollers 22 installed in the neighborhood of the taking-in port. The inlet rollers 22 are composed of an upper inlet roller 22*a* and a lower inlet roller 22*b*. The inlet rollers 22 are driven by an inlet roller motor 26.

Figure 12:
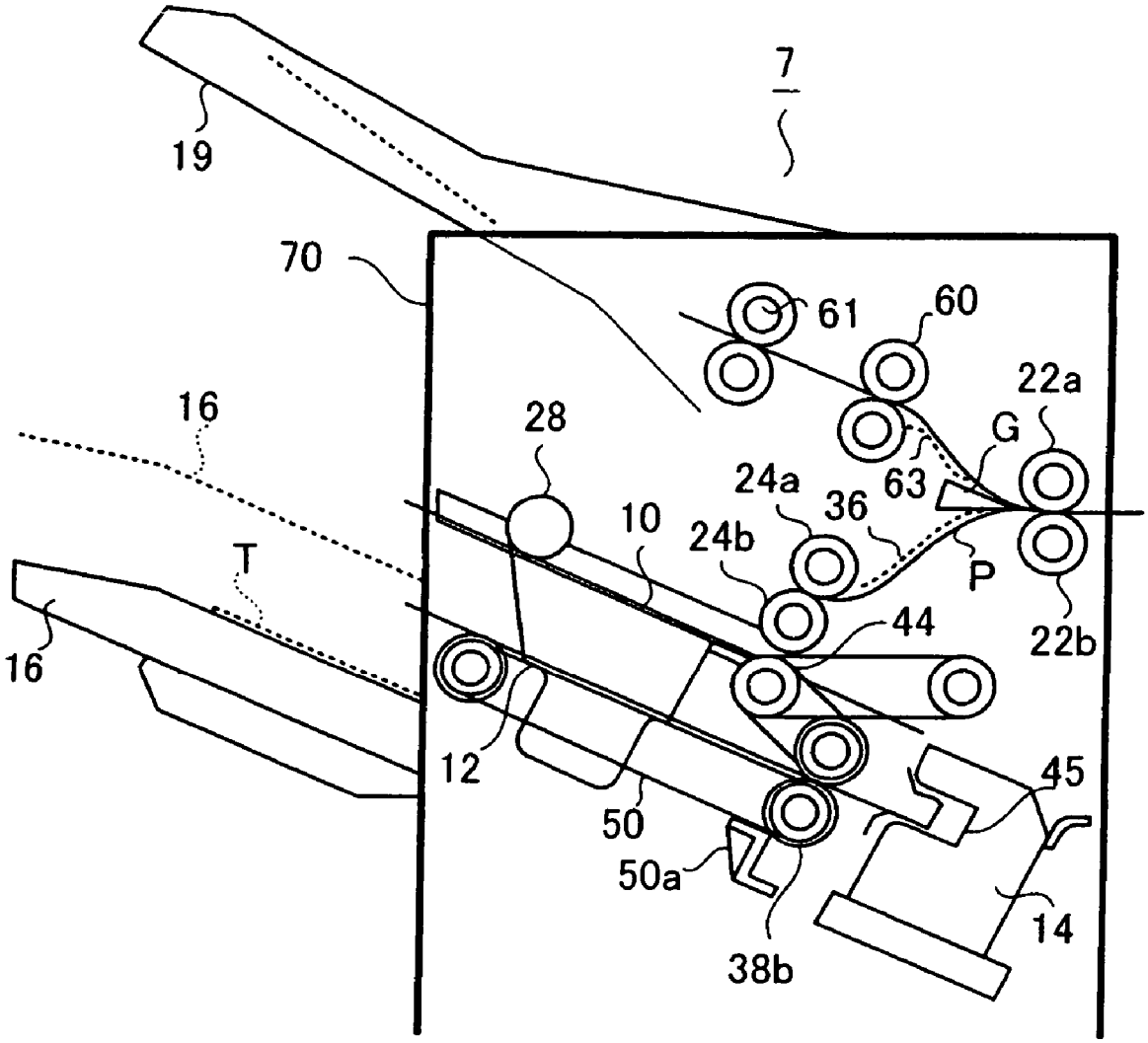
FIG. 12 is a schematic block diagram for explaining the conveying path of sheets of paper relating to an embodiment of the present invention.

As shown in FIG. 12, on the downstream side of the inlet rollers 22, the gate G for branching the sheet of paper P received by the inlet rollers 22 to two paths (flows) is installed. The gate G has a sectional shape of a wedge and the pointed part of the wedge is directed toward the neighborhood of the rotating surfaces of the inlet rollers 22. The gate G is rotatably born by the inner side wall of the sheet finishing apparatus 7. The pointed part of the wedge is set to the first position pointing towards the upper inlet roller 22*a* and the second position pointing towards the lower inlet roller 22*b*.

Namely, the first position is used to select the path when sheets of paper P require the post process and the second position is used to select the path when sheets of paper P do not require the post process.

When the gate G is set in the first position, sheets of paper P are supplied to the first paper supply rollers 24 and are sent to the standby tray 10 from the paper supply rollers 24. Between the inlet rollers 22 and the standby tray 10, a paper path ceiling 36 for leading sheets of paper P to the first paper supply rollers 24 is installed. The first paper supply rollers 24 are composed of an upper pinch roller 24*a* and a lower pinch roller 24*b*.

Under the standby tray 10, the processing tray 12 for loading sheets of paper P dropped and supplied from the standby tray 10 is arranged.

Figure 7:
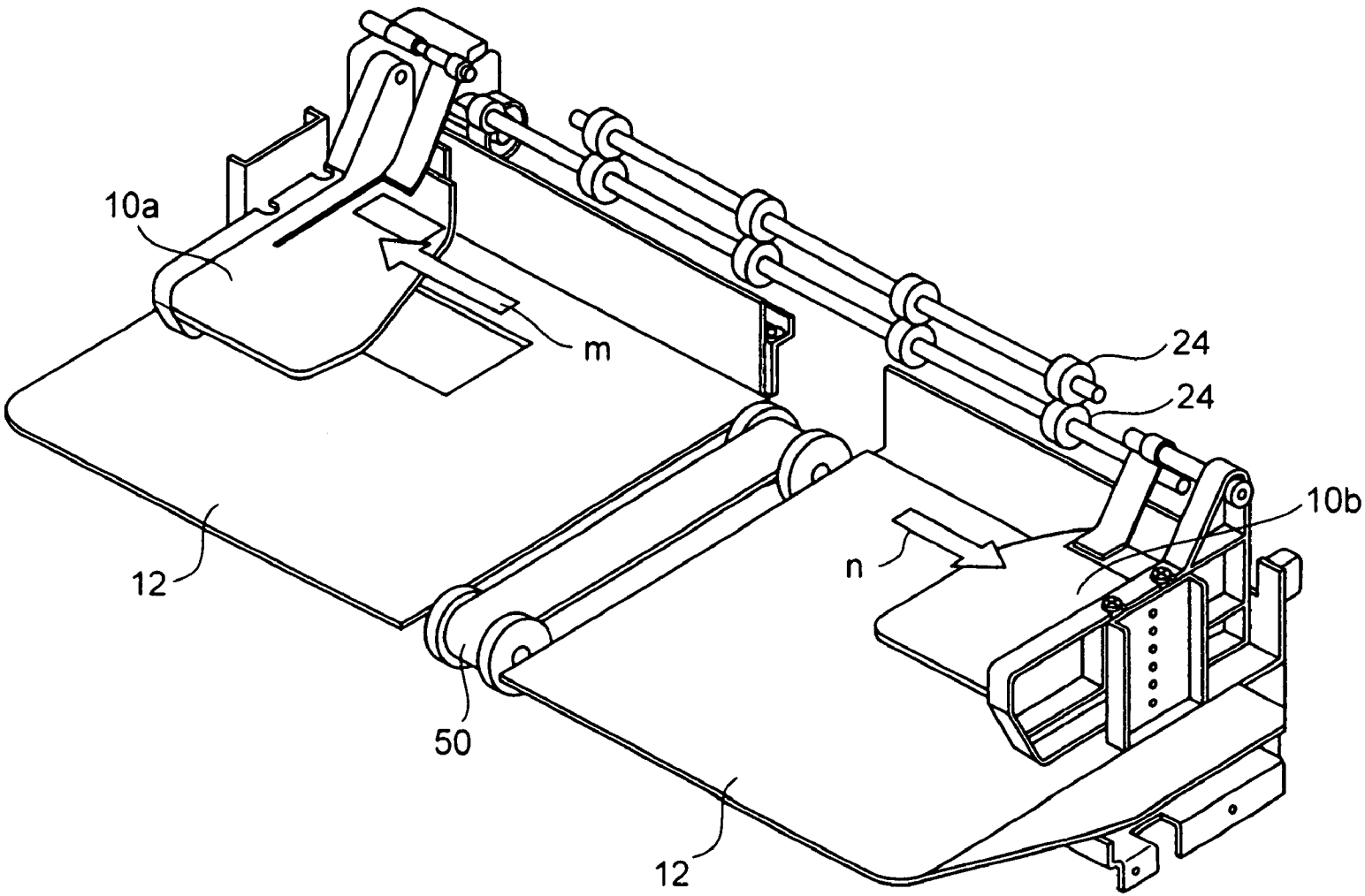
FIG. 7 is a schematic perspective view showing the standby tray and processing tray relating to an embodiment of the present invention.

The processing tray 12, while sheets of paper P are stapled by the stapler 14 which is a processing mechanism for performing the post process, matches and supports the sheets of paper P to be loaded. As shown in FIG. 7, when a predetermined number of sheets of paper is stored in the standby tray 10, standby tray parts 10*a* and 10*b* are opened in the horizontal direction in the drawing by a standby tray motor 34 and the sheets of paper P are dropped on the processing tray 12 by their own weight.

Figure 4:
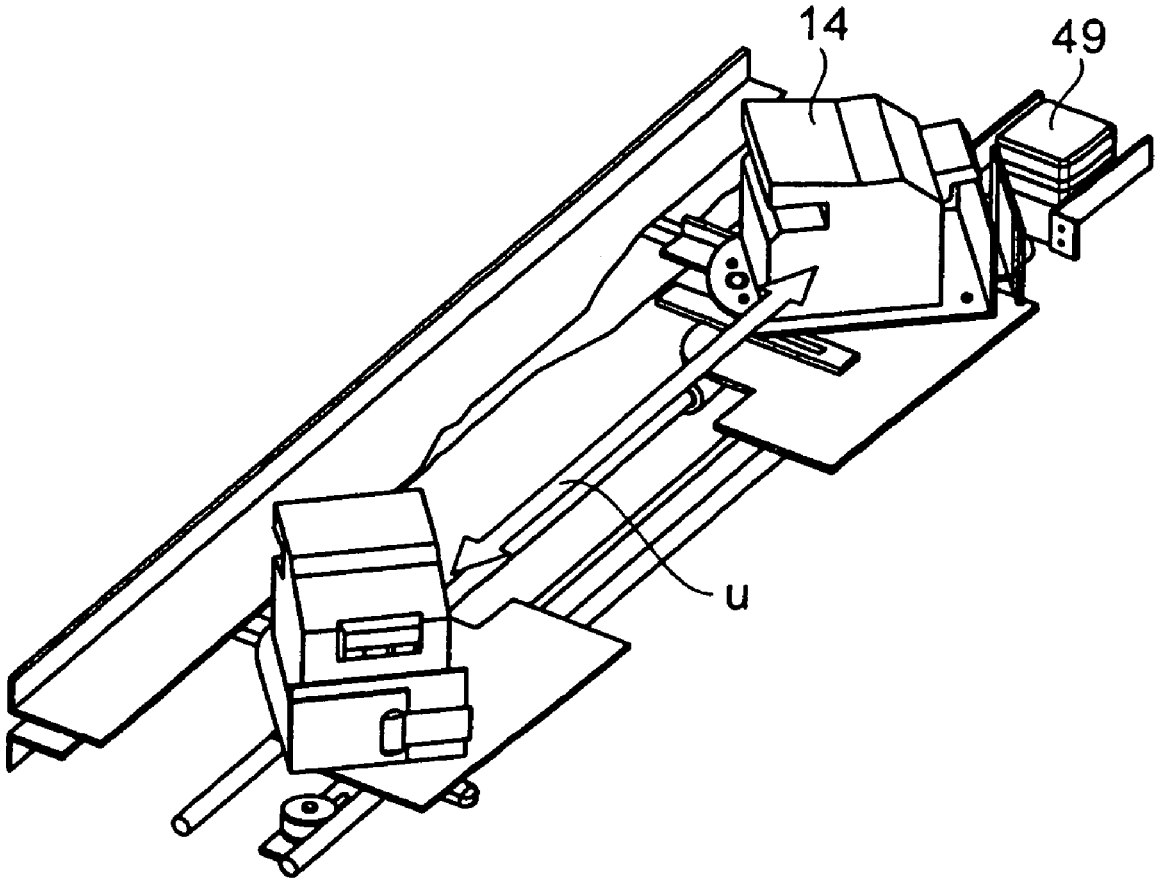
FIG. 4 is a perspective view showing the stapler of the sheet finishing apparatus relating to an embodiment of the present invention.

As shown in FIG. 4, the stapler 14 is slidden and positioned in the direction u by a stapler driving unit 49 and staples sheets of paper. The processing tray 12, to match a plurality of sheets of paper P dropped and supplied from the standby tray 10 in the vertical direction which is the conveying direction, has a pair of upper vertical matching roller 38*a* and lower vertical matching roller 38*b* shown in FIG. 5. The upper and lower vertical matching rollers 38*a* and 38*b* serve as bundle conveying rollers for clamping a sheet bundle T after the end of the stapling process and taking it out from the stapler 14. The upper vertical matching roller 38*a* is driven by a vertical matching upper roller motor 40 and the lower vertical matching roller 38*b* is driven by a vertical matching lower roller motor 42.

Figure 6:
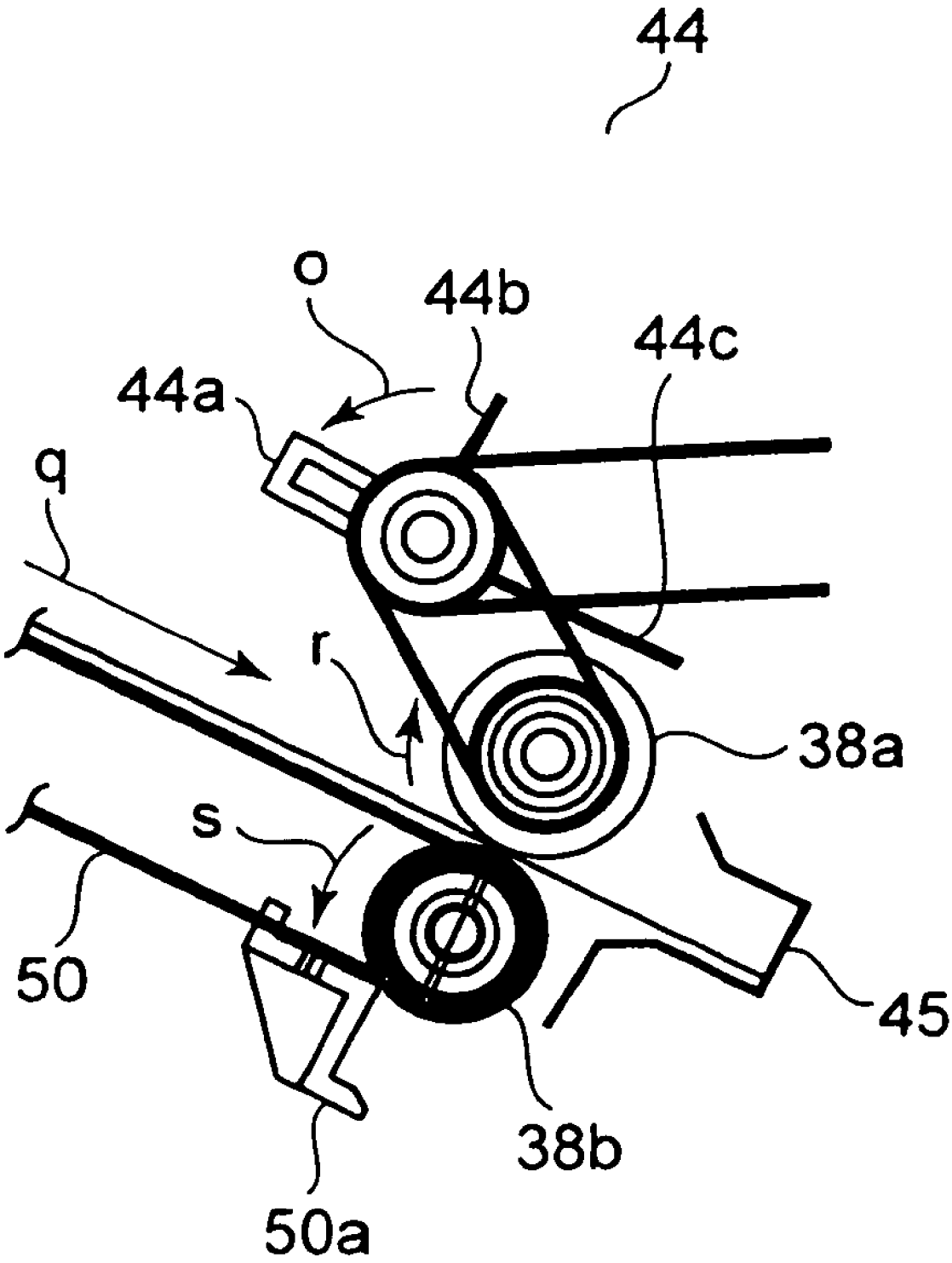
FIG. 6 is an illustration showing the paddle relating to an embodiment of the present invention.

Further, when sheets of paper P are dropped and supplied onto the processing tray 12, at the position where the rear end of each sheet of paper P is dropped, a paddle 44 rotatable for matching the uppermost sheet of paper P loaded on the processing tray 12 in the vertical direction is arranged. The paddle 44, as shown in FIG. 6, has a receiver 44*a* for receiving sheets of paper P dropped and supplied onto the processing tray 12, a tapping portion 44*b* for tapping down sheets of paper P onto the processing tray 12, and a feeder 44*c* for matching sheets of paper P on the processing tray 12 and is driven by a paddle motor 46. The paddle 44 is made of rubber and is elastic.

At the end of the processing tray 12 on the side of the stapler 14, a stopper 45 for making contact with the rear end of each sheet of paper P and controlling the rear end position is installed. Almost at the center of the processing tray 12, a conveying belt 50 for conveying a sheet bundle T which is stapled and taken out from the stapler 14 by the upper and lower vertical matching rollers 38*a* and 38*b* to the first or second paper ejection tray 16 or 18 is installed. To the conveying belt 50, a feeding pawl 50*a* for catching the rear end of the sheet bundle T is attached.

The standby tray 10 can drop and supply sheets of paper P to the processing tray 12 and also can convey the sheets of paper P toward the first or second paper ejection tray 16 or 18 and conveying the sheets of paper P toward the paper ejection trays 16 and 18 is executed by a standby tray roller 28 for matching sheets of paper P making contact with the sheets of paper P on the standby tray 10. The standby tray roller 28 is controlled to move up and down by a standby tray roller driving source 30 and is driven to rotate by a standby tray roller motor 32.

The standby tray 10 is arranged at an angle of inclination of θ 1 so as to support sheets of paper P in a state that the front end of each sheet of paper P is positioned higher than the rear end thereof. The first or second paper ejection tray 16 or 18 is moved up and down by a paper ejection tray driving unit 52 and either of them is selected. The first or second paper ejection tray 16 or 18, when loading sheets of paper P, is moved up or down at an almost same height as that of the standby tray 10 or the processing tray 12 so as to improve the consistency of the position of sheets of paper P ejected. Further, the first or second paper ejection tray 16 or 18 is arranged at an angle of inclination of θ 2 so as to support sheets of paper P in a state that the front end of each sheet of paper P is positioned higher than the rear end thereof.

Figure 8:
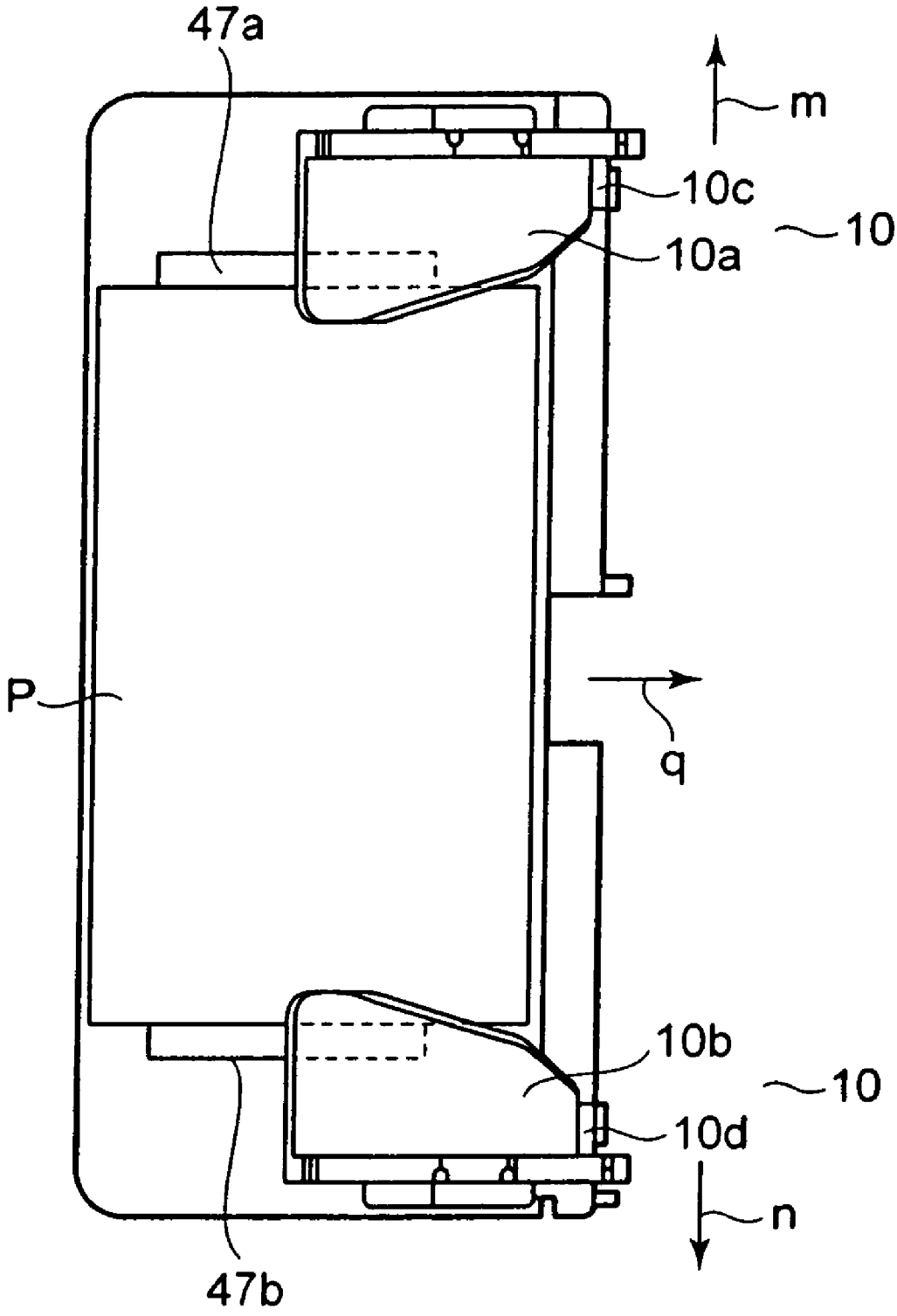
FIG. 8 is a top view showing the standby tray and processing tray relating to an embodiment of the present invention.

As shown in FIGS. 7 and 8, the standby tray 10 has the pair of tray members 10*a* and 10*b* formed so as to project from the wall surface thereof, receives each sheet of paper P by sliding in accordance with the width of the sheet of paper P, and supports both sides of the sheet of paper P. On the tray members 10*a* and 10*b*, standby stoppers 10*c* and 10*d* for controlling the rear end of each sheet of paper P are installed.

Figure 9:
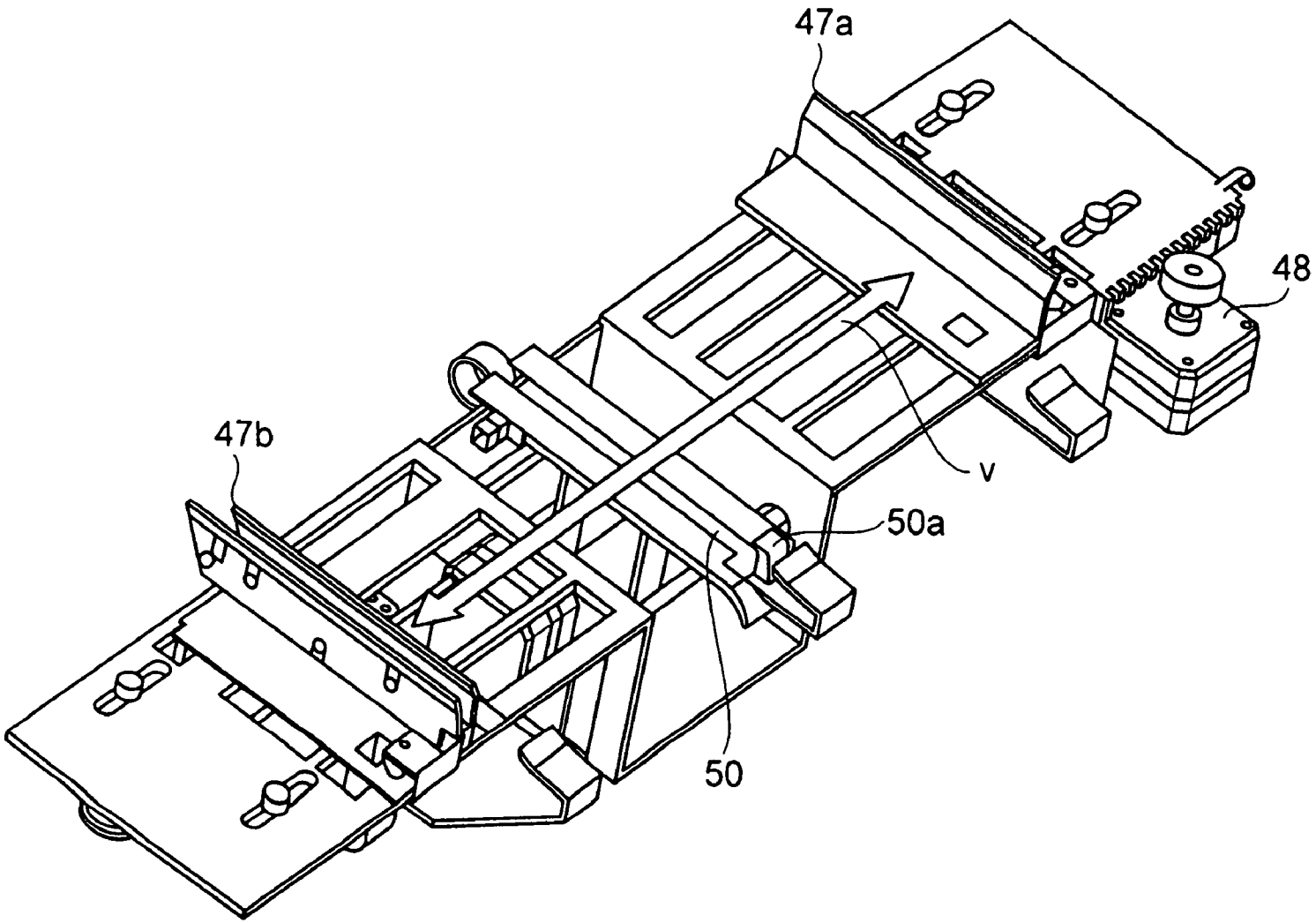
FIG. 9 is a schematic perspective view showing the horizontal matching plate and conveying belt relating to an embodiment of the present invention.

The standby tray 10 is slidden and moved by the standby tray motor 34. Between the standby tray 10 and the processing tray 12, when dropping and supplying sheets of paper P from the standby tray 10 onto the processing tray 12, horizontal matching plates 47*a* and 47*b*, shown in FIG. 9, for horizontally matching the sheets of paper P to prevent them from being disordered in the horizontal direction perpendicular to the conveying direction are installed. The horizontal matching plates 47*a* and 47*b* are formed so as to slide in the direction v in accordance with the width of the sheets of paper P by a horizontal matching motor 48.

When the gate G is at the second position as shown in FIG. 12, sheets of paper P requiring no post process are supplied to second paper supply rollers 60 and moreover supplied to third paper supply rollers 61. The second paper supply rollers 60 and the third paper supply rollers 61 are respectively composed of an upper paper supply roller and a lower paper supply roller. A paper path 63 for leading sheets of paper P branching at the gate G from the inlet rollers 22 to the second paper supply rollers is installed.

Furthermore, the sheets of paper P conveyed from the third paper supply rollers 61 are sent to the fixing tray 19 installed on the top of the sheet finishing apparatus 7. The fixing tray 19 is attached switchably to the top of the body 70 of the sheet finishing apparatus 7.

Figure 13:
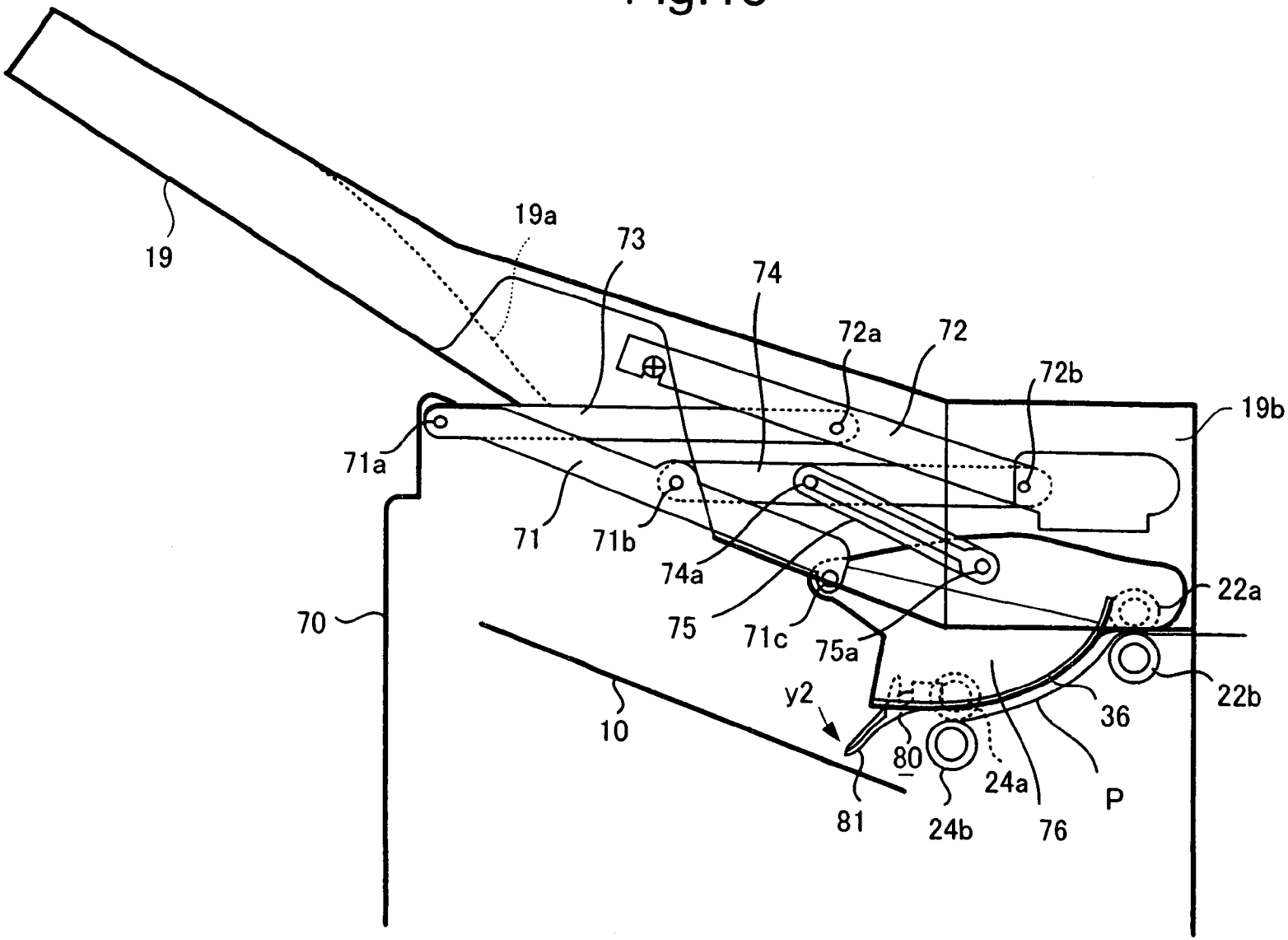
FIG. 13 is an illustration for explaining the jam processing mechanism relating to an embodiment of the present invention.

FIG. 13 shows the jam processing mechanism mainly including the switching structure of the fixing tray 19. In FIG. 13, the fixing tray 19 has a bottom 19*a* for receiving ejected sheets of paper and a side wall 19*b* and to the top of the body 70 on the opposite side of the sheet taking-in side, a first fixing member 71 is attached slantwise. Further, to the side wall 19*b* of the fixing tray 19, a second fixing member 72 is attached slantwise.

Between an upper end 71*a* of the first fixing member 71 and an intermediate part 72*a* of the second fixing member 72, a first link member 73 is connected and between an intermediate part 71*b* of the first fixing member 71 and a lower end 72*b* of the second fixing member 72, a second link member 74 is connected. The first and second link members 73 and 74 form parallel links and are arranged at a predetermined interval in parallel attached to the first fixing member 71 and the second fixing member 72.

Further, to an intermediate part 74*a* of the link member 74, one end of a connection link 75 is connected rotatably and another end 75*a* of the connection link 75 is connected rotatably to a sheet guidance member 76. To the sheet guidance member 76, the paper path ceiling 36 is attached and is supported rotatably by a lower end 71*c* of the first fixing member 71.

The first link member 73 rotates at the fulcrums of 71*a* and 72*a* and the second link member 74 rotates at the fulcrums of 71*b* and 72*b*. Further, the connection link 75 rotates at the fulcrums of 74*a* and 75*a* and the sheet guidance member 76 rotates at the fulcrum of 71*c*. Further, by the sheet guidance member 76, the upper inlet roller 22*a* of the pair of inlet rollers 22 and the upper pinch roller 24*a* of the pair of paper supply rollers 24 are supported.

Figure 14:
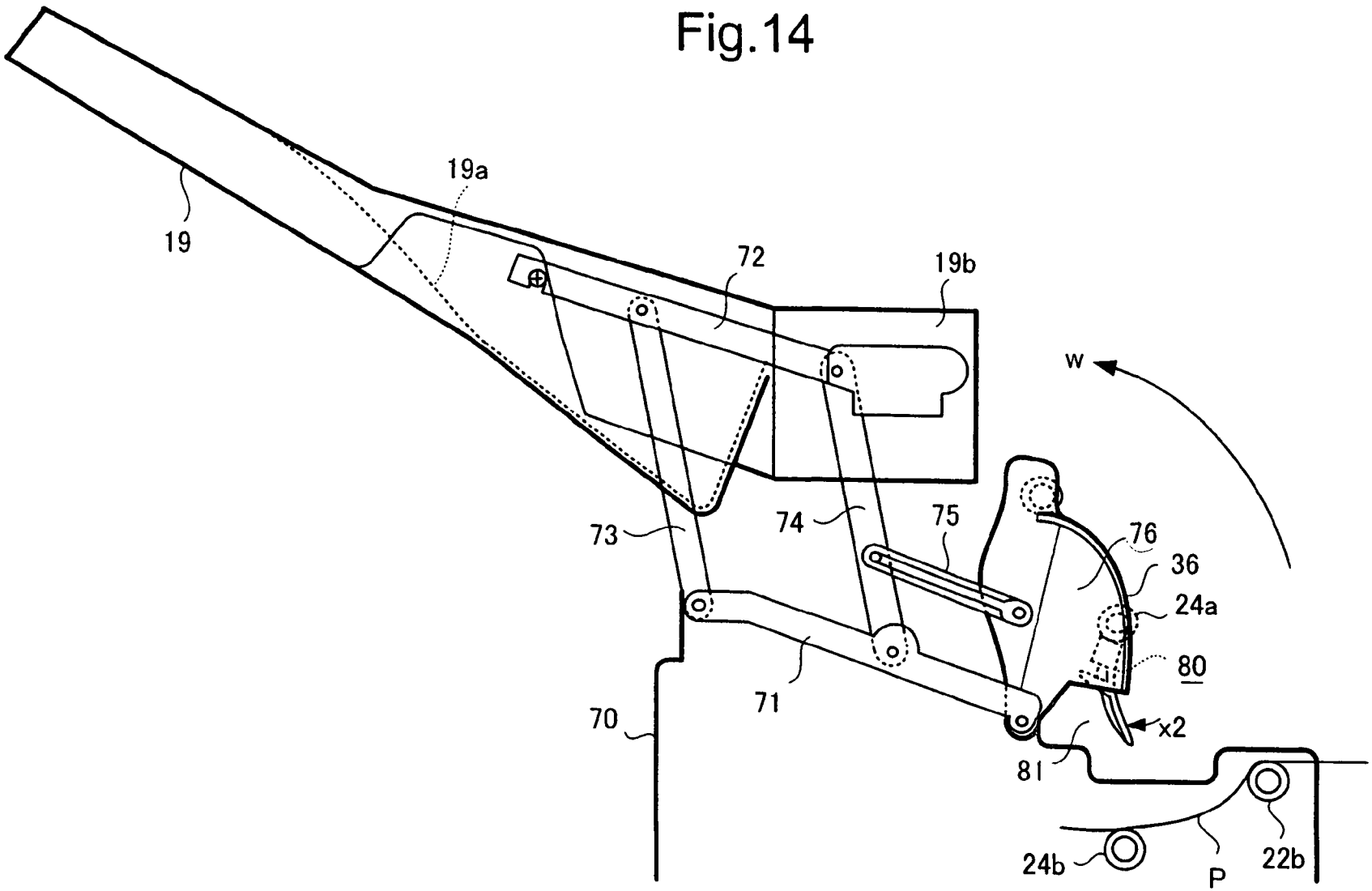
FIG. 14 is an illustration for explaining the operation of the jam processing mechanism relating to an embodiment of the present invention.

And, when paper jamming occurs in the conveying path of sheets of paper, as shown in FIG. 14, the fixing tray 19 can be opened. Namely, when jamming occurs, the fixing tray 19 can be opened in the direction of the arrow w shown in FIG. 14 from the closed condition (low height position) shown in FIG. 13, and the first and second link members 73 and 74 constituting the parallel links rotate almost vertically, and the fixing tray 10 moves upward to the high position. Further, in correspondence to the rotation of the second link member 74, the connection link 75 is pulled and the sheet guidance member 76 simultaneously rises vertically and is opened.

When the sheet guidance member 76 is opened, the upper inlet roller 22*a* and lower inlet roller 22*b* and the upper paper supply roller 24*a* and lower paper supply roller 24*b* are separated from each other, so that the conveying path of sheets of paper is exposed and even if a sheet of paper is jammed between the rollers 22 and 24, it can be taken out easily.

Further, by use of the parallel links 73 and 74, the fixing tray 19 rotates in the direction w and rises up to the high second height position, though even if this occurs, the angle of inclination of the fixing tray 19 is changed little. Therefore, even if there is already a sheet of paper ejected on the bottom 19*a*, it will not drop out though the fixing tray 19 is opened.

On the other hand, to the sheet guidance member 76, to press sheets of paper P loaded on the standby tray 10, an assist arm 80 is attached. The assist arm 80, as described in detail in FIG. 15, has an arm 81 extending on one end side and a holder 82 clamping rotatably a rotary central shaft 24*c* of the pinch roller 24*a* at the other end, and a fulcrum 83 is installed at a position slightly away from the holder 82, and the fulcrum 83 is attached to the sheet guidance member 76, and the assist arm 80 can rotate round the fulcrum 83.

The assist arm 80 rotates in accordance with the movement of the shaft 24*c* of the pinch roller 24*a*, when the fixing tray 19 is closed, as shown in FIG. 13, rotates in the direction for pressing sheets of paper P loaded on the standby tray 10, and when the fixing tray 19 is open, as shown in FIG. 14, rotates in the opposite direction. The detailed operation will be described later by referring to FIG. 15.

Further, the motors 26, 34, 40, 42, 46, and 48 for driving various mechanisms aforementioned and the driving units 49 and 52 are driven and controlled by a control circuit (not drawn).

Next, the operation of the invention will be described. When an image is formed by the image forming apparatus 5 and a sheet of paper P is supplied from the paper ejection rollers 6, the sheet finishing apparatus 7 performs a different operation depending on execution of the post process of the sheet of paper P or no execution thereof, or during execution of the post process of the preceding sheet of paper P or end of the post process.

When the post process is not performed, the pointed part of the wedge of the gate G is at the second position almost pointing the lower inlet roller 22*b*. The sheet of paper P supplied from the inlet rollers 22 is supplied to the second paper supply rollers 60 and then supplied to the third paper supply rollers 61. The sheet of paper P taken out from the third paper supply roller is ejected to the fixing tray 19 on the top.

Next, a case that the stapling process which is the post process is to be performed and there is no sheet of paper P on the processing tray 12 will be described. At this time, the standby tray 10 slides and moves the tray members 10*a* and 10*b* respectively up to the positions indicated by the dotted lines shown in FIG. 11 in the direction of the arrow m and the direction of the arrow n and opens the drop and supply path of sheets of paper P. Further, the horizontal matching plates 47*a* and 47*b*, to horizontally match sheets of paper P dropped from the paper supply rollers 24, are arranged so that the interval between the horizontal matching plates 47*a* and 47*b* becomes almost equal to the width of the sheets of paper P. By doing this, the sheets of paper P supplied from the paper supply rollers 24 are directly dropped and supplied onto the processing tray 12 unless the conveyance is interrupted by the standby tray 10.

At the time of drop and supply, the upper vertical matching roller 38*a* is shifted upward and the receiver 44*a* of the paddle 44 receives the rear end of each sheet of paper P. The sheet of paper P drops in a state that both sides thereof are in contact with the horizontal matching plates 47*a* and 47*b* and is matched horizontally. Then, the paddle 44 rotates in the direction of the arrow o shown in FIG. 6 and the rear end of the sheet of paper P drops from the receiver 44*a* and is tapped down onto the processing tray 12 by the tapping portion 44*b*. Furthermore, the paddle 44 sends the sheet of paper P in the direction of the arrow q by the feeder 44*c*, and the rear end of the sheet of paper P makes contact with the stopper 45, and the matching of the sheet of paper P in the vertical direction is completed. Further, the vertical matching of sheets of paper P on the processing tray 12 may be executed by the upper vertical matching roller 38*a* by moving it up and down each time.

In this way, the sheets of paper P with an image formed thereon are sequentially matched in the horizontal direction and vertical direction and are loaded directly on the processing tray 12 from the paper supply rollers 24. When the sheets of paper Preach a predetermined number of sheets, the stapler 14 staples and bundles the sheets of paper P on the processing tray 12 at a desired position to form a sheet bundle T. Hereafter, as shown in FIG. 6, the sheet bundle T is clamped by the upper vertical matching roller 38*a* rotating in the direction of the arrow r and the lower vertical matching roller 38*b* rotating in the direction of the arrow s and is conveyed to the first paper ejection tray 16.

Figure 5:
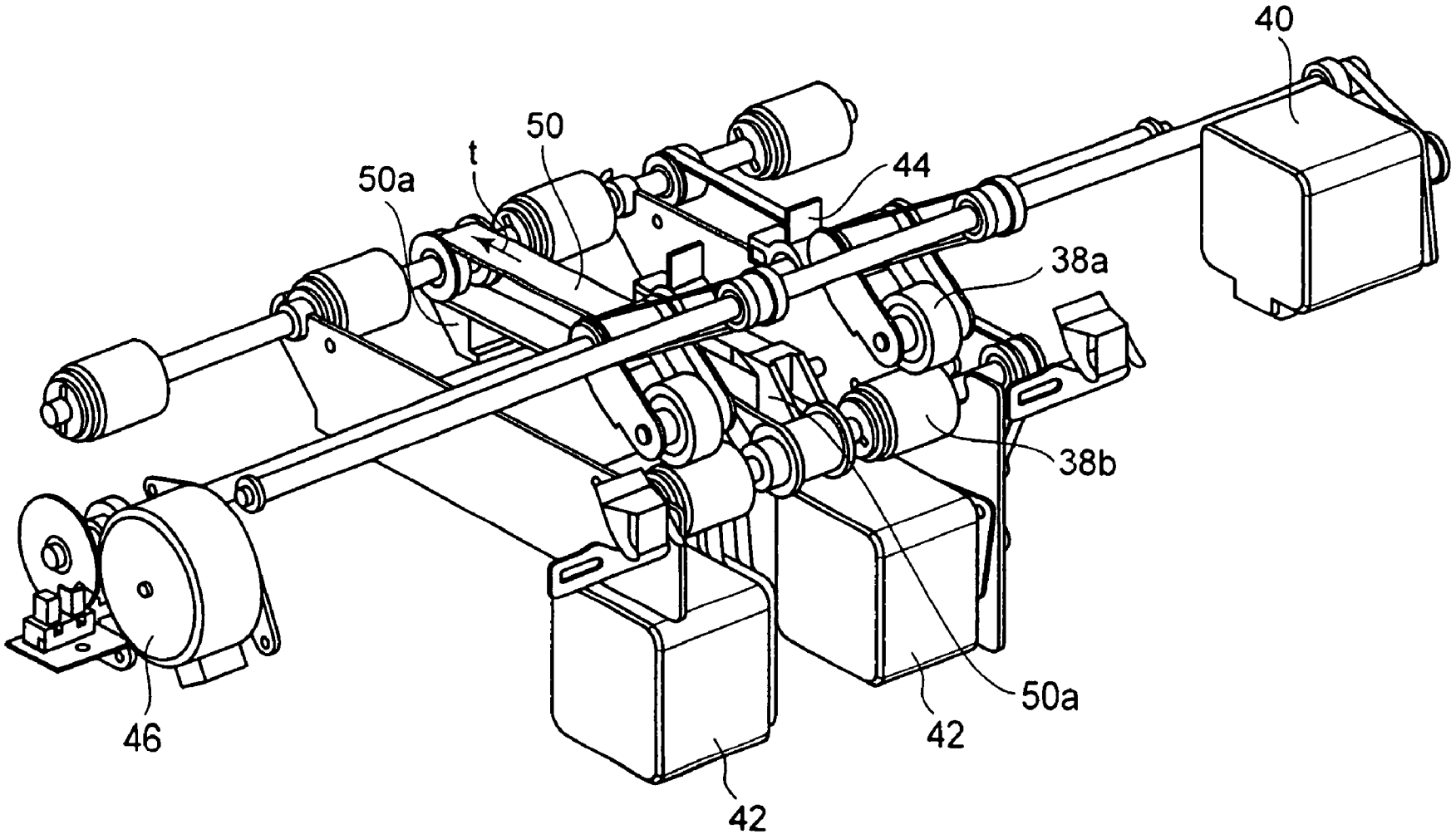
FIG. 5 is a perspective view showing the vertical matching roller relating to an embodiment of the present invention.

When the rear end of the sheet bundle T passes the upper and lower vertical matching rollers 38*a* and 38*b*, it is caught by the feeding pawl 50*a* of the conveying belt 50 rotating in the direction of the arrow t shown in FIG. 5 and the bundle is sent onto the first paper ejection tray 16. At this time, the first paper ejection tray 16 slides and moves from the position indicated by the dotted line in FIG. 3 to the position indicated by the solid line.

Further, the first paper ejection tray 16 is arranged at an angle of inclination of θ 2 and the front end of each sheet of paper is positioned higher than the rear end thereof, so that the sheets of paper P of the bundle precedingly sent onto the first paper ejection tray 16 are not pressed out by contact with the front end of the succeeding sheet bundle T. Further, even if the preceding sheet bundle T is slightly shifted by the succeeding sheets of paper P, the angle of inclination θ 2 is provided, so that the sheet bundle T drops by its own weight and is matched and loaded on the first paper ejection tray 16 in the state that the rear ends are properly arranged, and the stapling process of the sheets of paper P is completed.

Figure 10:
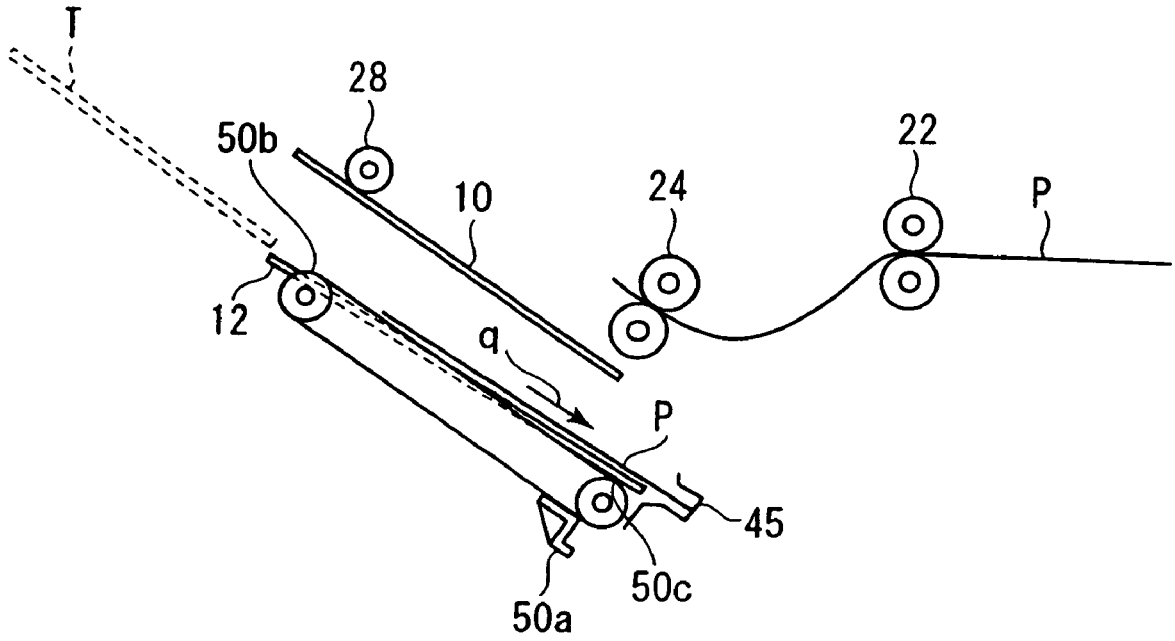
FIG. 10 is an illustration showing the condition that a sheet of paper on the standby tray or paper ejection tray relating to an embodiment of the present invention is pressed out.

In this way, sheets of paper are sequentially loaded on the first paper ejection tray 16. Further, the first paper ejection tray 16 is arranged at an angle of inclination of θ 2, so that for example, even if a sheet of paper P is ejected onto the first paper ejection tray 16 in a state that it is curved convexly as shown by the dotted line in FIG. 10, the sheet of paper P preceidingly loaded on the paper ejection tray 16 is not pressed out by contact with the front end of the succeeding sheet of paper P. Namely, the ejected sheet of paper P is sequentially loaded on the first paper ejection tray 16 unless the order is disturbed.

Next, a case that the stapling process which is the post process is to be performed and a preceding sheet of paper P during execution of the stapling process remains on the processing tray 12 will be described. At this time, the standby tray 10 slides and moves the tray members 10*a* and 10*b* from the positions indicated by the dotted lines shown in FIG. 11 respectively in the opposite direction of the direction of the arrow m and the opposite direction of the direction of the arrow n and can support the sheets of paper P in the positions indicated by the solid lines shown in FIG. 11. Further, the standby tray roller 28 is shifted upward not to disturb the sheets of paper P. Sheets of paper P which are ejected from the image forming apparatus 5 and supplied by the paper supply rollers 24 are loaded once on the standby tray 10 to wait for the processing tray 12 to become empty.

The sheets of paper P loaded on the standby tray 10, by the standby tray roller 28 which drops on the standby tray 10 and rotates in the opposite direction of the direction of the arrow f shown in FIG. 3, are sent toward the standby stoppers 10*c* and 10*d* and are vertically matched in a state that the rear end of each sheet of paper P is in contact with the standby stoppers 10*c* and 10*d*. Furthermore, the standby tray 10 is arranged at an angle of inclination of θ 1 and the front end of each sheet of paper is positioned higher than the rear end thereof, so that the rear end of each sheet of paper P makes contact with the standby stoppers 10*c* and 10*d* and the sheets of paper are vertically matched.

Further, the standby tray 10 is arranged at an angle of inclination of θ 1, so that for example, even if a sheet of paper P is supplied from the paper supply rollers 24 in the state that it is curved convexly and supplied onto the standby tray 10, the sheet of paper P preceidingly loaded on the standby tray 10 is not pressed out by contact with the front end of the succeeding sheet of paper P. Namely, the supplied sheet of paper P is sequentially loaded on the first paper ejection tray 16 unless the order is disturbed.

Figure 11:
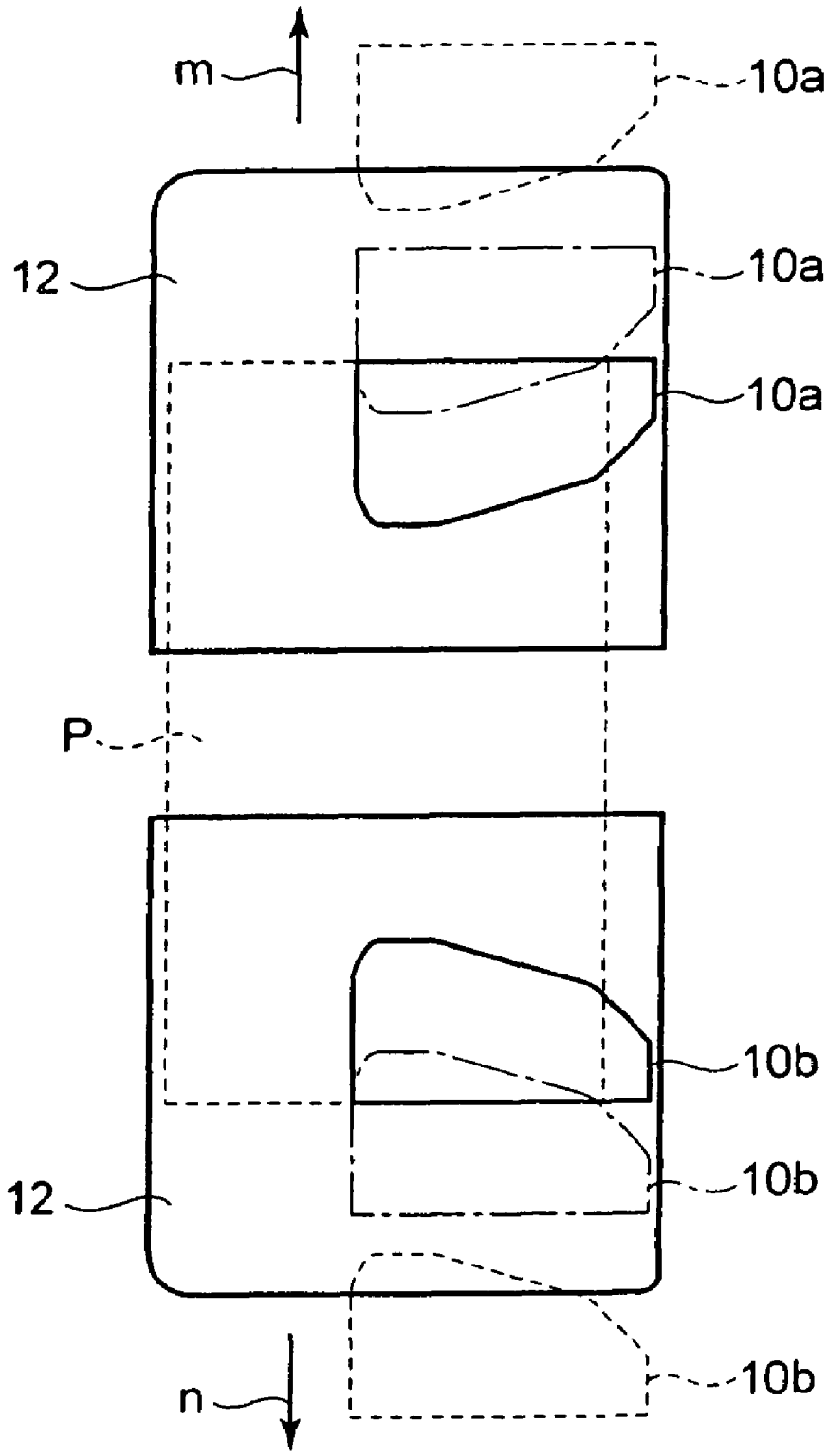
FIG. 11 is an illustration showing the movement of the standby tray relating to an embodiment of the present invention.

During this period, when the preceding sheet of paper P on the processing tray 12 is ejected on the side of the first paper ejection tray 16 and the processing tray 12 becomes empty, the standby tray 10 slides and moves the tray members 10*a* and 10*b* respectively in the direction of the arrow m and the direction of the arrow n from the positions indicated by the solid lines shown in FIG. 11 via the positions indicated by the alternate long and short dash lines shown in FIG. 11 up to the positions indicated by the dotted lines shown in FIG. 11. By doing this, for example, two sheets of paper P waiting on the standby tray 10, when the tray members 10*a* and 10*b* reach the positions indicated by the alternate long and short dash lines shown in FIG. 11, are dropped and supplied onto the processing tray 12 through the interval between the tray members 10*a* and 10*b*. At this time, the interval between the horizontal matching plates 47*a* and 47*b* is made almost equal to the width of the sheets of paper P. Therefore, the sheets of paper P dropped from the standby tray 10 are matched horizontally with both sides controlled by the horizontal matching plates 47*a* and 47*b*.

The lower side sheet of paper P of the two sheets of paper P dropped on the processing tray 12 is sent in the direction of the arrow q by the lower vertical matching roller 38*b* rotating in the opposite direction of the direction of the arrow s shown in FIG. 6, and the rear end of the sheet of paper P makes contact with the stopper 45, and the vertical matching of the sheet of paper P is completed. The upper side sheet of paper P of the two sheets of paper P dropped on the processing tray 12 is sent in the direction of the arrow q by the upper vertical matching roller 38*a* rotating in the opposite direction of the direction of the arrow r, and the rear end of the sheet of paper P makes contact with the stopper 45, and the vertical matching of the sheet of paper P is completed, and hereafter the upper vertical matching roller 38*a* is shifted upward.

The third and subsequent sheets of paper P ejected from the image forming apparatus 5 are directly dropped and supplied onto the processing tray 12 from the interval between the tray members 10*a* and 10*b* unless they wait on the standby tray 10. Hereafter, the third and subsequent sheets of paper P are sequentially matched on the sheets of paper P loaded on the processing tray 12 before the paddle 44.

When sheets of paper P loaded on the processing tray 12 reach a predetermined number of sheets, the sheets of paper P are stapled by the stapler 14 and a sheet bundle T is formed. Hereafter, the sheet bundle T is conveyed toward the first paper ejection tray 16 by the upper and lower vertical matching rollers 38*a* and 38*b*, and moreover the rear end thereof is caught by the feeding pawl 50*a* of the conveying belt 50, and the bundle is sent onto the first paper ejection tray 16, and the stapling process of the sheets of paper P is completed.

On the other hand, when the stapling process of sheets of paper is not required, the gate G shown in FIG. 12 is switched to the second position and sheets of paper P conveyed from the image forming apparatus body 5 are supplied to the second paper supply rollers 60 and then are ejected to the fixing tray 19 on the top via the third paper supply roller 61.

Further, when paper jamming occurs in the conveying path of sheets of paper, as shown in FIG. 14, the fixing tray 19 is opened, and the sheet guidance member 76 simultaneously rises vertically, and even if a sheet of paper is jammed, it can be taken out easily.

Figure 15:
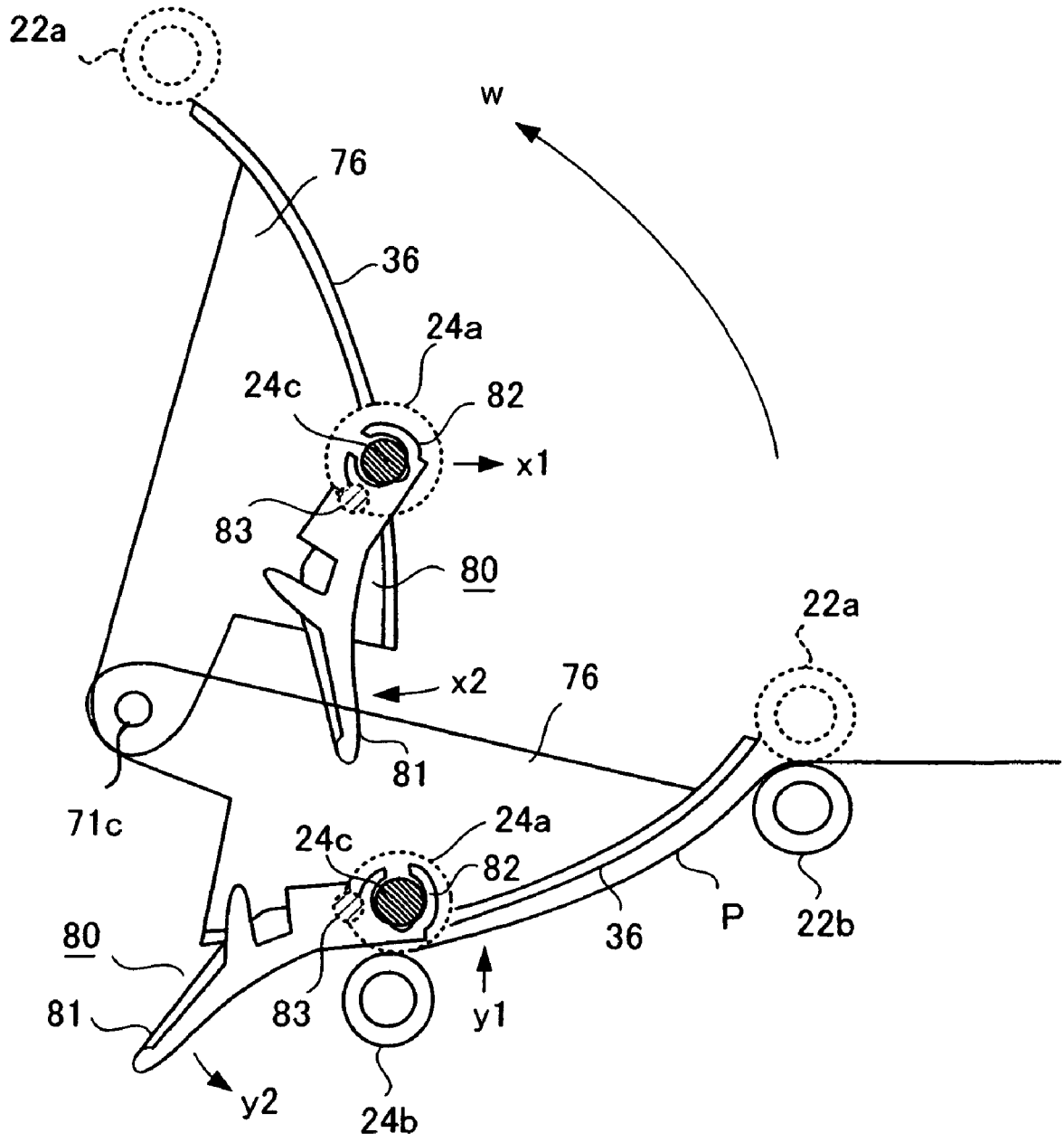
FIG. 15 is an illustration for explaining the assist mechanism for conveying sheets of paper relating to an embodiment of the present invention.

Next, the operation of the assist arm 80 will be explained by referring to FIG. 15. FIG. 15 shows mainly the essential section of the sheet guidance member 76 and the assist arm 80, explains the situation of movement of the sheet guidance member 76 from the closed condition to the open condition in correspondence with switching of the fixing tray 19, and also shows the movement of the assist arm 80.

Namely, so that the upper pinch roller 24*a* and the lower pinch roller 24*b*, when conveying sheets of paper, make contact closely with each other, the upper pinch roller 24*a* is pressed toward the lower pinch roller 24*b* by a spring member (not drawn).

When the upper pinch roller 24*a* and the lower pinch roller 24*b* make contact with each other, the pinch roller 24*a* is pushed up in the direction of the arrow y1 against the force of the spring member, and the shaft 24*c* also rises simultaneously in the direction y1, and the assist arm 80 rotates round the fulcrum 83, and the arm 81 moves down in the direction of the arrow y2. By doing this, the arm 81 operates so as to press the rear end of each of the sheets of paper loaded on the standby tray 10 to prevent them from a undesirable position.

Further, when the sheet guidance member 76 moves to the open condition, the pinch roller 24*a* is released from the lower pinch roller 24*b*, and the pinch roller 24*a* moves at a predetermined distance in the direction of the arrow x1 by the spring member, and the shaft 24*c* also moves in the direction x1, and the assist arm 80 rotates round the fulcrum 83, and the arm 81 moves in the direction of the arrow x2.

Therefore, when closing again the sheet guidance member 76 after the end of the jam process, the arm 81 is moved inside (in the direction x2) already, so that the front end of the arm 81 can be prevented from a collision with the shaft of the lower pinch roller 24*b* and the sheet guidance member can be closed smoothly. Further, the assist arm 80 can be prevented from damage. And, when the sheet guidance member is closed, the pinch roller 24*a* is raised in the direction y1, so that the front end of the arm 81 moves down in the direction y2 and can press sheets of paper on the standby tray 10.

Namely, when closing the sheet guidance member 76, the assist arm 80 does not interfere with the sheet conveying path and the sheet guidance member can be switched smoothly.

In this embodiment structured like this, when paper jamming occurs, a user only opens the fixing tray 19, thus he can easily remove the sheet of paper jammed and the assist arm 80 does not interfere with the sheet conveying path. Therefore, the efficiency by the image forming apparatus is not reduced and a sheet finishing apparatus convenient for the user can be obtained.

Further, in the present invention, the post process performed for sheets of paper loaded on the processing tray is the stapling process. However, the post process is not limited to the stapling process and for example, the post process such as a hole punching (hole boring) process performed for sheets of paper is not questionable. In this case, one sheet of paper instead of a plurality of sheets of paper may be loaded unquestionably on the processing tray. Further, needless to say, for a post processing apparatus having such a post processing mechanism, the present invention produces an effect.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet finishing apparatus, comprising:

a conveying path in which a sheet of paper ejected from an image forming device is carried from a receiving port, and a pair of pinch rollers pressed against each other so as to make contact closely with each other and convey the sheet of paper for post process;

a sheet guidance member that supports one of the pair of pinch rollers, and is turnable between a first position where one of the pinch rollers and the other pinch roller contact with each other and a second position where the one of the pinch rollers is released from the other pinch roller;

a tray used for loading the sheet of paper conveyed by the pair of pinch rollers; and an assist arm mounted in the sheet guidance member in a rotatable manner that makes contact with the sheet of paper being conveyed, wherein the assist arm rotates in correspondence with movement of the pinch rollers, in a manner that, in a state where the tray is closed, the assist arm rotates in a direction in which one end thereof presses the sheet of paper, and in a state where the tray is open, the assist arm rotates in an opposite direction; and wherein the assist arm has an arm extending from one end side, a holder that holds a rotation center axis of the pinch rollers in a rotatable manner on the other end, and a fulcrum provided at a position distant from the holder, wherein the fulcrum can be attached to the sheet guidance member and the assist arm can be rotated centering on the fulcrum.

2. A sheet finishing apparatus, comprising:

a conveying path in which a sheet of paper ejected from an image forming device is carried from a receiving port, and a pair of pinch rollers pressed against each other so as to make contact closely with each other and convey the sheet of paper for post process;

a sheet guidance member that supports one of the pair of pinch rollers, and is turnable between a first position where one of the pinch rollers and the other pinch roller contact with each other and a second position where the one of the pinch rollers is released from the other pinch roller;

a tray used for loading the sheet of paper conveyed by the pair of pinch rollers; and an assist arm mounted in the sheet guidance member in a rotatable manner that makes contact with the sheet of paper being conveyed, wherein the assist arm rotates in correspondence with movement of the pinch rollers, in a manner that, in a state where the tray is closed, the assist arm rotates in a direction in which one end thereof presses the sheet of paper, and in a state where the tray is open, the assist arm rotates in an opposite direction; and Wherein the arm operates so as to press a rear end of the sheet of paper to prevent the sheet of paper from an undesirable position at the time where the pinch rollers make contact with each other in a state where the sheet guidance member is closed in correspondence with opening and closing the tray, the assist arm rotates centering on the fulcrum when the sheet guidance member moves to an open state in correspondence with the opening and closing of the tray, and a front end of the arm is prevented from a collision with a shaft of the pinch rollers when the sheet guidance member is closed again, since the arm has moved in a predetermined direction already.

* * * * *